United States Patent [19]

Eckert et al.

[11] 4,175,922

[45] Nov. 27, 1979

[54] DEHAIRING SKIN AND HIDE

[75] Inventors: Guenter Eckert, Limburgerhof; France Knaflic, Frankenthal; Franz-Friedrich Miller, Ludwigshafen; Alfred Zissel, Frankenthal, all of Fed. Rep. of Germany

[73] Assignee: Badische Anilin- & Soda-Fabrik Aktiengesellschaft, Fed. Rep. of Germany

[21] Appl. No.: 306,671

[22] Filed: Nov. 15, 1972

[30] Foreign Application Priority Data

Nov. 17, 1971 [DE] Fed. Rep. of Germany ..... 2157034

[51] Int. Cl.[2] ..... C14C 1/06

[52] U.S. Cl. ..... 8/94.16; 8/161

[58] Field of Search ..... 8/94, 16, 161

[56] References Cited

U.S. PATENT DOCUMENTS

| | | | |
|---|---|---|---|
| 1,973,130 | 9/1934 | Turley et al. | 8/94.16 |
| 2,352,524 | 6/1944 | Evans | 8/161 |

OTHER PUBLICATIONS

O'Flaherty et al., Technology of Leather, vol. 1, pp. 273–274, pub. 1956 by Reinhold Pub. Co., N.Y.C. TS 967 0 36 C2.

Alexander et al., "Wool and it Chemistry and Physics", pub. 1954, pp. 247 and 281, TS 1547 A4.

*Primary Examiner*—Donald Levy

*Attorney, Agent, or Firm*—Keil & Witherspoon

[57] ABSTRACT

Process for dehairing skin and hide with mercapto compounds in the presence of an alkaline medium in a short liquor.

6 Claims, No Drawings

DEHAIRING SKIN AND HIDE

The present invention relates to a process for completely dehairing skin and hide with organic mercapto compounds in an alkaline medium.

The best known reductive depilatories for skin and hide are sodium sulfide, sodium hydrosulfide and organic sulfur compounds such as mercaptans. The depilatories cause the reactive splitting of the —S—S— main valency bond of the cystine group in keratin. Simultaneously the weakened keratin is destroyed by alkaline hydrolysis.

This method has been described in various older references and is for example the subject of U.S. Pat. No. 1,973,130. This reference teaches mercaptans which may be used in combination with alkaline-reacting agents for dehairing skin and hide for example.

The teaching of U.S. Pat. No. 2,352,524 is even more specific where, for example, compounds such as thioglycol are used in combination with alkali and alkaline earth metal hydroxides in toilet requisites employed as depilatories.

The underlying principal in all these methods has always been or had to be that the process should be carried out in a long liquor if possible, since in a drumming process specifically in the dehairing of skin and hide a large amount of air can be expected to be introduced to the pelts requiring treatment. However, the introduction of large amounts of air is not particularly favorable to the stability particularly of sulfur compounds, as at least oxidation to disulfides may take place. For this reason a long liquor is used, because the large amount of water may provide certain protection against the oxidative attack of the atmospheric oxygen.

Consequently mercaptans as proposed by the older literature have not been able to finally establish themselves in the leather industry. Only in cosmetics has the use, for example, of thioglycolic acid gained acceptance in some cases as a depilatory or as a preparation for permanent waves.

The object of the invention was to provide a process which would enable the said sulfur compounds to be used in the leather industry after all and which would in particular enable the dehairing to be carried out with mercaptans in order to avoid the restrictions imposed by effluent regulations when using sulfides, since oxidative splitting is known to convert mercaptans into disulfides which present absolutely no pollution problem.

We have now found that these disadvantages can be obviated if the process for dehairing skin and hide is carried out using mercapto compounds together with alkali or alkaline earth metal hydroxides and if the dehairing is carried out with a liquor of 10 to 50 parts, with reference to 100 parts by weight of raw hide, and the liquor contains 1 to 2 parts by weight, with reference to 100 parts by weight of raw hide, of an α- or β-mercaptoalkanol of 2 to 6 carbon atoms and 2 to 4 parts by weight, with reference to 100 parts by weight of raw hide, of an alkali or alkaline earth metal hydroxide.

The length of the liquor with reference to the weight of raw hide is an important feature of the process of the invention because it surprisingly enables a genuine liming process to be carried out in the vat with a minimum of liquid portions, the chemicals being able to act in concentrated form on the skin and hide.

In the case of prior art dehairing processes in the vat or similar dehairing methods it was known that a reduction of the liquor volume, i.e. of the amount of water used, promoted the drumming effect which runs parallel to a more intensive contacting of the contents of the vat, which consist of skins, chemicals and water, with air. Consequently is is surprising that, in spite of the accelerated oxidation which this makes possible, the mercaptoalkanols used in the said small amounts achieve the required effect without being previously oxidized. In addition the cleaning action of the mercaptoalkanols on the scud is particularly important. High-class leather is obtained from the pelts treated in accordance with the invention.

Dehairing processes using sodium sulfide or hydrosulfide have the disadvantage that the effluent contains a substantial concentration of sulfide ions. When the process with mercaptoalkanols was carried out according to the invention, it was observed that after dehairing had been carried out for more than eight hours only traces of sulfide ions, detectable with cadmium acetate, could be found in the effluent. In spite of their good dehairing action the mercaptoalkanols exhibit adequate oxidizability under the operating conditions described to be converted subsequently into the thioether or disulfide compounds which have no toxic or keratolytic action.

Mercaptoalkanols to be used according to the invention may be all those containing 2 to 6, preferably 2 to 3, carbon atoms as long as they contain the mercapto group in α- or β-position to the hydroxyl group.

Mercaptoethanol and mercaptoisopropanol are preferred compounds. The mercaptoalkenols are used advantageously in concentrations of 1 to 2 parts by weight, with reference to 100 parts of raw hide, and are employed most advantageously in the form of their alkali metal salts, whereby, in order to prevent the aqueous solutions from salting out, longer chain polyhydroxy compounds may be added, as for example di- or tripropylene glycol, which also increase the solubility product of the alkal or alkaline earth metal hydroxides and thus improve the opening up of the skin. The alkali or alkaline earth metal hydroxides which may be present according to the invention in concentrations of 2 to 4 parts by weight, with reference to 100 parts of raw hide, may be any of this type although hydroxides such as calcium hydroxide are preferred.

The volume of the liquor should be chosen according to the invention so that to 100 parts by weight of raw hide there are approximately 10 to 50 parts of liquid (liquor) which contains the other components in accordance with the invention.

The drumming process is a known operation with which anybody skilled in the leather field is familiar and therefore requires no special comment here. It is an advantage in the drumming process to add small amounts (about 0.5 part with reference to the weight of the hide) of molasses to improve the solubility of the preferred calcium hydroxide.

The following Examples further illustrate the invention without limiting it.

EXAMPLE 1

Raw material: cow hides, salted weight 30 kg, well soaked

Drum lime (4 revolutions per minute)

20% water (30° C.)

2% α-mercaptoethanol

4% calcium hydroxide (powder)
2% sodium hydroxide solution (50%)
0.5% molasses (technical grade)
Drum 30 min.
Allow to rest 30 min.
Drum 30 min.
Allow to rest 30 min.
Add 200% water (28° C.)
Drum 30 min.
Duration of liming 10 to 20 hours The limed hides are further processed by conventional methods.

EXAMPLE 2

Raw material: bull hides, salted weight 50 kg, well soaked

Lime in hide processor

The soaking liquor is run off and there is added:
1.5% α-mercaptoethanol
1.0% sodium hydroxide solution (50%)
2% calcium hydroxide (powder)
0.2% non-ionic alkali-resistant wetting agent Agitate for two hours (7 revolutions per minute) and add: 50% water (25° C.)
Agitate for 30 min.
Duration of liming: 5 to 16 hours.

The hides thus limed are further processed by conventional methods.

EXAMPLE 3

Raw material: dried North African goat skins.
Percentages refer to the soaked weight of skins.
Drum lime:
10% water (30° C.)
2% α-mercaptoethanol
6% calcium hydroxide
2% sodium hydroxide solution (50%)
0.5% dipropylene glycol
0.2% non-ionic wetting agent
Agitate 1 hour
Allow to rest 1 hour
Agitate 10 minutes
Allow to rest 1 hour
Add: 300% water (25° C.)
Agitate 10 minutes
Duration of liming: 1 to 2 days The skins thus limed are further processed by conventional methods.

We claim:

1. In a drumming process for dehairing animal skin and hide using sulfur compounds in the presence of alkali or alkaline earth metal hydroxides the improvement which comprises carrying out the dehairing by drumming the animal hides or skins in the presence of air in a liquor of 10 to 50 parts by weight with reference to 100 parts by weight of raw hide, the liquor containing 1 to 2 parts by weight, with reference to 100 parts by weight of raw hide, of an α- or β-mercaptoalkanol of 2 to 6 carbon atoms and 2 to 4 parts by weight, with reference to 100 parts by weight of raw hide, of an alkali or alkaline earth metal hydroxide.

2. In a process as claimed in claim 1 the improvement which comprises using a liquor containing mercaptoethanol or mercaptoisopropanol.

3. In a process as claimed in claim 2 the improvement which comprises using a liquor containing calcium hydroxide.

4. In a process as claimed in claim 1 the improvement which comprises using a liquor containing calcium hydroxide.

5. In a process as claimed in claim 1 the improvement wherein the dehaired hides are limed and further treated to produce leather.

6. In a process as claimed in claim 1 the improvement wherein the resultant liquor, after use in the dehairing process, contains only trace amounts of sulfide ions.

* * * * *